US008638183B2

(12) United States Patent
Freimuth et al.

(10) Patent No.: US 8,638,183 B2
(45) Date of Patent: Jan. 28, 2014

(54) POWER SWITCH HAVING INTEGRATED TRIGGER AND DRIVE UNIT

(75) Inventors: Michael Freimuth, Hirschau (DE); Jürgen Renner, Traβlberg (DE); Matthias Weiss, Vilseck (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/382,649

(22) PCT Filed: Jun. 25, 2010

(86) PCT No.: PCT/EP2010/059047

§ 371 (c)(1), (2), (4) Date: Feb. 6, 2012

(87) PCT Pub. No.: WO2011/003751

PCT Pub. Date: Jan. 13, 2011

(65) Prior Publication Data

US 2012/0126917 A1 May 24, 2012

(30) Foreign Application Priority Data

Jul. 9, 2009 (DE) ..... 10 2009 033 275

(51) Int. Cl.
*H01H 3/00* (2006.01)

(52) U.S. Cl.
USPC ..... 335/185

(58) Field of Classification Search
USPC ..... 335/78, 127–135, 172–176, 185–191, 335/203, 255, 274
See application file for complete search history.

(56) References Cited

U.S. PATENT DOCUMENTS

| | | | | |
|---|---|---|---|---|
| 3,069,519 | A | 12/1962 | Waters | |
| 4,922,216 | A | 5/1990 | Dietrich | |
| 5,250,920 | A | 10/1993 | Fujihisa et al. | |
| 5,268,662 | A * | 12/1993 | Uetsuhara et al. | 335/229 |
| 5,467,069 | A * | 11/1995 | Payet-Burin et al. | 335/42 |

(Continued)

FOREIGN PATENT DOCUMENTS

| | | |
|---|---|---|
| DE | 650810 C | 10/1937 |
| DE | 3802184 A1 | 8/1989 |

(Continued)

OTHER PUBLICATIONS

International Search Report for International Application No. PCT/EP2010/059047 dated Jan. 12, 2011.

*Primary Examiner* — Bernard Rojas
(74) *Attorney, Agent, or Firm* — Harness, Dickey & Pierce, P.L.C.

(57) ABSTRACT

A power switch includes switch contacts that are opened via a switch shaft, which, when the switch is triggered, is actuated by way of the trigger slider of a trigger unit, in particular a working current trigger unit. The trigger slider moves the switch shaft by way of the trigger shaft of a switch latch, the trigger unit including electric coil into which an armature extends that is drawn into the coil by electromagnetic forces of attraction when the switch is triggered. A stationary counter armature is disposed in the coil, which counter armature serves as a stop for the armature, so as to increase the forces of attraction. The movement of the armature is transmitted by way of a mechanism to the movement of the trigger slider so as to increase the displacement path of the trigger slider.

10 Claims, 2 Drawing Sheets

(56) References Cited

U.S. PATENT DOCUMENTS

| | | | | |
|---|---|---|---|---|
| 5,894,257 | A | 4/1999 | Roger et al. | |
| 5,949,314 | A | 9/1999 | Spengler et al. | |
| 6,577,217 | B1 * | 6/2003 | Bournarie et al. | 335/282 |
| 6,794,963 | B2 * | 9/2004 | O'Keeffe et al. | 335/21 |
| 2004/0263294 | A1 | 12/2004 | Ahlert et al. | |

FOREIGN PATENT DOCUMENTS

| | | | |
|---|---|---|---|
| DE | 69718265 | T2 | 8/2003 |
| DE | 10320681 | A1 | 12/2004 |
| EP | 0315093 | A2 | 5/1989 |
| EP | 0315093 | A2 | 5/1989 |
| EP | 0320686 | A2 | 6/1989 |
| EP | 0320686 | A2 | 6/1989 |
| EP | 325725 | | 8/1989 |
| EP | 0544928 | A1 | 6/1993 |
| EP | 0544928 | A1 | 6/1993 |
| EP | 0901140 | A2 | 3/1999 |
| EP | 0901140 | A2 | 3/1999 |
| JP | 2001155593 | A | 6/2001 |
| JP | 2001155593 | A | 6/2001 |

* cited by examiner

POWER SWITCH HAVING INTEGRATED TRIGGER AND DRIVE UNIT

PRIORITY STATEMENT

This application is the national phase under 35 U.S.C. §371 of PCT International Application No. PCT/EP2010/059047 which has an International filing date of Jun. 25, 2010, which designated the United States of America, and which claims priority to German patent application number DE 10 2009 033 275.8 filed Jul. 9, 2009, the entire contents of each of which are hereby incorporated herein by reference.

FIELD

At least one embodiment of the invention generally relates to a power switch.

BACKGROUND

Power switches are in particular known as low-voltage power switches. They have switch contacts which are opened via a switch shaft. The switch shaft is actuated by means of a trigger slider via the trigger shaft of a switch latch. The trigger slider is part of the working current trigger unit of the power switch. Besides the trigger slider the working current trigger unit has an electric coil into which an armature extends which is often designed as a longitudinally moveable iron core armature. When triggered, the armature is drawn into the coil by means of magnetic forces of attraction.

SUMMARY

At least one embodiment of the invention proposes a technically simple power switch that does not require energy storage e.g. in the form of a spring loaded accumulator.

At least one embodiment of the invention provides that in the coil a stationary armature is disposed in the coil, which counter armature serves as a stop for the armature so as to increase the forces of attraction, and the movement of the armature is transmitted by way of a mechanism to the movement of the trigger slider so as to increase the displacement path of the trigger slider.

In the proposed power switch of an embodiment, the very great forces which occur during convergence on the counter armature are reduced by a mandatory enlargement of the displacement path. The great forces which have occurred in this displacement area are used to move the trigger slider sufficiently far where there are still relatively great forces (trigger forces). Only this enables direct actuation of the trigger shaft and consequently the feed shaft. The disadvantage of a drawing solenoid is quasi corrected, namely that the magnetic force decreases disproportionately with the distance from the stop of the counter armature. The mechanism ensures that the release lever has a sufficiently large path for a small armature hub.

A simple and effective embodiment provides that the armature and the counter armature have flat front sides turned towards each other.

It is technically simple if transmission through the mechanism has a slotted link.

The slotted link is advantageously designed in such a way that the force-displacement curve of the armature movement is converted into a force-displacement curve of the trigger slider in which the force over the displacement path remains the same.

BRIEF DESCRIPTION OF THE DRAWINGS

The invention is described in more detail below on the basis of an example embodiment. The figures show.

DETAILED DESCRIPTION OF THE EXAMPLE EMBODIMENTS

Figure 1:
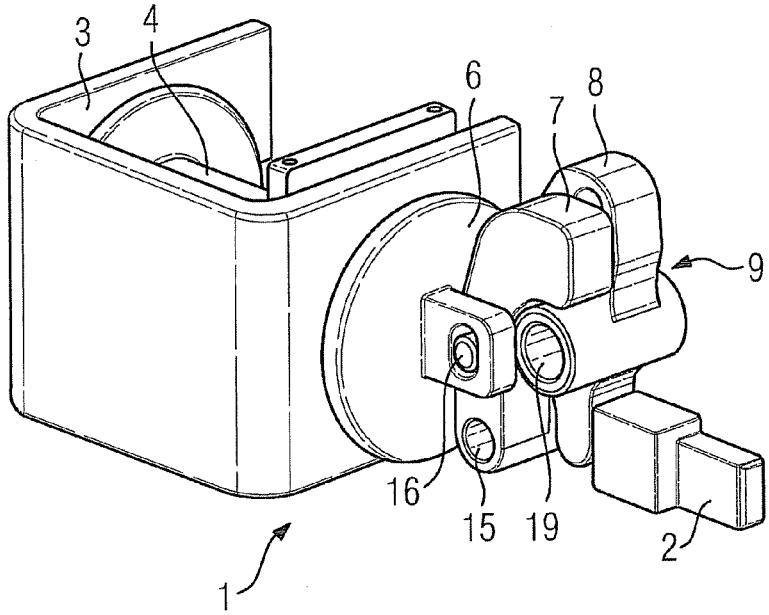
FIG. 1 the trigger unit of a power switch.

FIG. 1 shows a trigger unit 1 of a power switch which is not shown, which has a switch contact which is opened via a feed shaft. The feed shaft is actuated via a trigger shaft of a switch latch which is not shown. When triggered, a trigger slider 2 is displaced for this purpose.

The trigger unit 1 is shown in FIG. 1 without housing; it has a U-shaped ferromagnetic component 3, in which a coil 4 is arranged. An armature 5 (see FIG. 2) extends into the coil 4, of which in FIG. 1 only the anchor plate 6 is visible outside the ovoid component 3. The anchor plate 6 moves two interacting release levers (transmission lever 7, tripper device 8), which together form a mechanism 9 which transfers the longitudinal movement (longitudinal displacement) of the armature 5 into a longitudinal displacement of the trigger slider 2. If the armature 5 is drawn into the coil 4, then the trigger slider 2 is displaced in the opposite direction.

Figure 2:
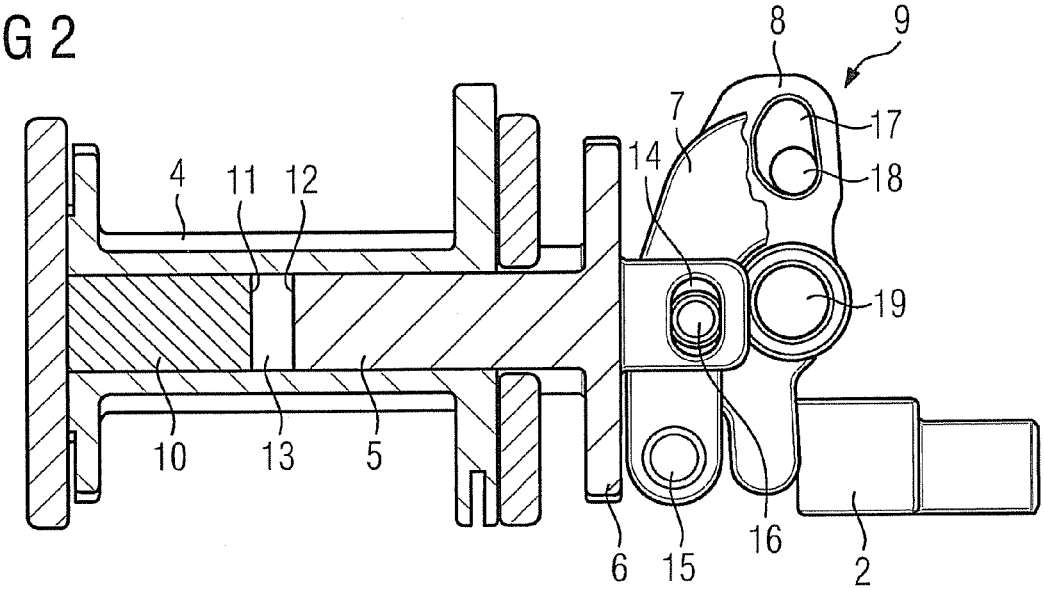
FIG. 2 the trigger unit according to FIG. 1 in a cutaway view.

FIG. 2 shows the trigger unit 1 as a longitudinal section in which the armature 5 faces a counter armature 10. This counter armature 10 has the task of increasing the magnetic forces of attraction on the armature and of forming a stop for the armature 5. In FIG. 2 the fronts 11, 12 are shown at a distance from each other, i.e. between fronts 11, 12 there is an intermediate space 13.

The transmission lever 7 is stored via an elongated bushing 14 on the armature 5, for its support on the housing of the trigger unit 1 there is a pivot 15, around which the transmission lever 7 can be pivoted. When the pivot 15 is pivoted (by the armature 5), a bolt 16 attached to the transmission lever 7 in the elongated bushing 14 moves up and down. The swivel movement of the transmission lever 7 is transmitted to the tripper device 8 by means of a slotted link 17. The slotted link is located in the transmission lever 7 in the form of a correspondingly shaped recess, in which a pin 18 fastened to the upper end of the transmission lever 7 engages. The tripper device 8 designed as a dual lever can be rotated on an axis 19. Its lever end (in FIG. 2 below) presses against it and pushes the trigger slider 2 in its longitudinal direction when the armature 5 is drawn into the coil 4.

If the coil 5 is energized, on account of the magnetic forces of attraction the armature 5 moves towards the stop 11. The armature 5 draws the transmission lever 7 in FIG. 2 to the left, which in turn draws the tripper device 8 to the left. In FIG. 2 this presses with its lower lever end on the trigger slider 2, which transmits the force accordingly and—as described above—triggers the power, switch.

Figure 3:
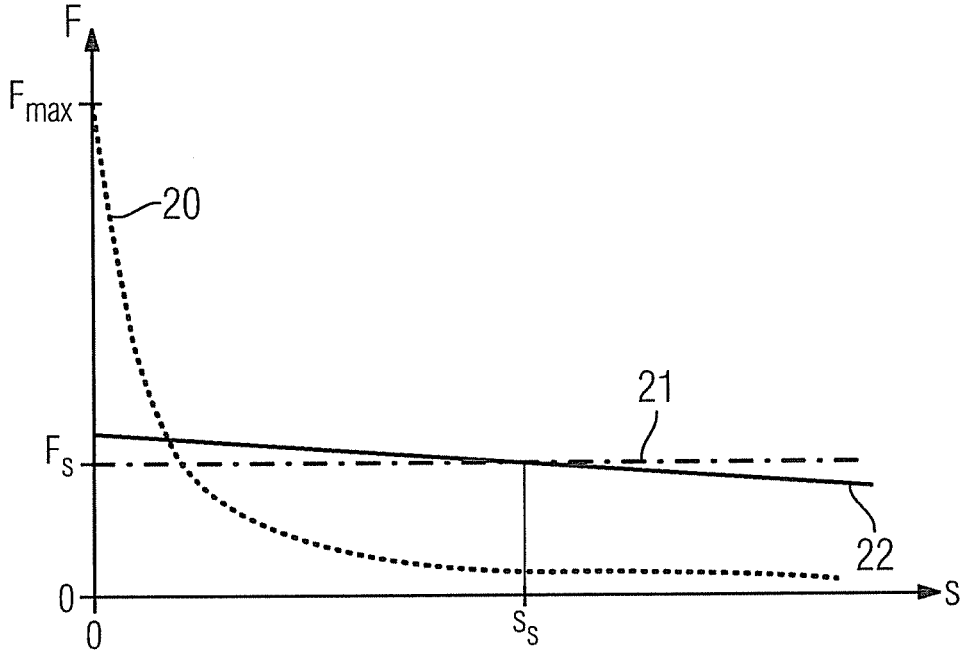
FIG. 3 force-displacement curve of the trigger unit according to FIG. 2.

FIG. 3 shows the force-displacement curve 20 of the armature 5, the desired force-displacement curve 21 of the trigger slider 2 and the force-displacement curve 22 of the trigger slider 2 obtained by means of the slotted link 17. F is the force over the path S, where Fmax is the maximum armature force and Fs and Ss are the desired value for the force on the trigger slider 2 or the desired path of the trigger slider 2 as target values. The slotted link 17 must be shaped accordingly for the force-displacement curve 22 in order to maintain the nearly constant force over the entire displacement path. The force-displacement curve 20 of the armature 5 in FIG. 3 shows the disproportionately (quadratically) increasing force of attraction with the convergence of the armature 5 on the counter armature 10 per path unit.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A power switch including switch contacts, openable via a switch shaft which, when the switch is triggered, are actuated by way of a trigger slider of a trigger unit, the trigger slider being adapted to move the switch shaft by way of a trigger shaft of a switch latch, the trigger unit comprising:

an electric coil;

a movable armature that is drawn into the coil by electromagnetic forces of attraction when the switch is triggered;

a stationary counter armature in the coil, the stationary counter armature being a stop for the armature when the switch is triggered so as to increase forces of attraction, and movement of the armature being transmitted by way of a mechanism to movement of the trigger slider, so as to increase a displacement path of the trigger slider.

2. The power switch of claim 1, wherein the armature and the counter armature include flat fronts turned towards each other.

3. The power switch of claim 1, wherein the mechanism includes a slotted link in which a pin is reciprically movable within the slotted link.

4. The power switch of claim 3, wherein the slotted link is adapted to convert a force-displacement curve of the armature movement into a force-displacement curve of the trigger slider with constant force via the displacement path.

5. The power switch of claim 2, wherein the mechanism includes an elongated slot within which a pin is reciprically movable within the elongated slot.

6. The power switch of claim 5, wherein the elongated slot is adapted to convert a force-displacement curve of the armature movement into a force-displacement curve of the trigger slider with constant force via the displacement path.

7. The power switch of claim 1, wherein the trigger unit is a working current trigger unit.

8. The power switch of claim 1, wherein the movable armature and the stationary aramture are brought into contact when the coil is energized.

9. The power switch of claim 1, wherein the movable armature includes on elongated bushing at a longitudinal end thereof.

10. The power switch of claim 9, wherein a bolt is reciprocally movable within the bushing in a direction transverse to a direction of movement of the movable armature.

* * * * *